US005383591A

United States Patent [19]

Thibert

[11] Patent Number: 5,383,591

[45] Date of Patent: Jan. 24, 1995

[54] INTERFACE DEVICE BETWEEN A FEEDING DEVICE AND A RECEIVING STATION FOR PHOTOGRAPHIC MATERIAL

[75] Inventor: Daniel G. Thibert, Chalon Sur Saone Cedex, France

[73] Assignee: Eastman Kodak Company, Rochester, N.Y.

[21] Appl. No.: 952,897

[22] PCT Filed: May 29, 1991

[86] PCT No.: PCT/FR91/00421

§ 371 Date: Nov. 20, 1992

§ 102(e) Date: Nov. 20, 1992

[87] PCT Pub. No.: WO91/20016

PCT Pub. Date: Dec. 26, 1991

[30] Foreign Application Priority Data

Jun. 11, 1990 [FR] France ..... 90 07464

[51] Int. Cl.[6] ..... B65M 29/00

[52] U.S. Cl. ..... 226/108; 226/44; 226/92; 355/321

[58] Field of Search ..... 226/108, 92, 44; 242/71.1; 355/72, 321

[56] References Cited

U.S. PATENT DOCUMENTS

| | | | |
|---|---|---|---|
| 3,384,281 | 5/1968 | Mason | 226/44 X |
| 3,800,992 | 4/1974 | Yamagishi | 226/108 X |
| 4,147,427 | 4/1979 | Stewart | 355/72 |
| 4,429,988 | 2/1984 | Okabe | 355/28 |
| 4,741,439 | 5/1988 | Bizic | 206/316 |
| 4,909,426 | 3/1990 | Crowley et al. | 226/108 |
| 4,967,222 | 10/1990 | Nitsch | 226/108 X |
| 5,029,742 | 7/1991 | Theilacker et al. | 226/92 |
| 5,107,296 | 4/1992 | Ozawa et al. | 355/72 X |
| 5,153,661 | 10/1992 | Shimizu et al. | 355/321 X |
| 5,187,531 | 2/1993 | Ozawa et al. | 355/72 X |

FOREIGN PATENT DOCUMENTS

| | | |
|---|---|---|
| 2705181 | 8/1978 | Germany . |
| 3034083 | 3/1982 | Germany . |
| 60-2555(A) | 1/1985 | Japan . |
| 2041567 | 9/1980 | United Kingdom . |

*Primary Examiner*—Daniel P. Stodola
*Assistant Examiner*—John P. Darling
*Attorney, Agent, or Firm*—Clyde E. Bailey

[57] ABSTRACT

An interface device (10) connects in a light tight manner a feeding device (11) with a receiving station (12) fitted with a feed opening (13) and a driving device (60) liable to move a web (153) inserted into the feed opening (13) with a given tension force. Provided are first means for connecting the interface device (10) to the feeding device (11) and a second means for connecting the interface device (10) to the receiving station (12). A driving roller (42) is provided for pulling the web (153) out of the feeding device (11) in order to form a loop (53) which controls a regulating system (56). Regulating system (56) controls the speed of the rotation of motor (41) connected to driving roller (42).

2 Claims, 1 Drawing Sheet

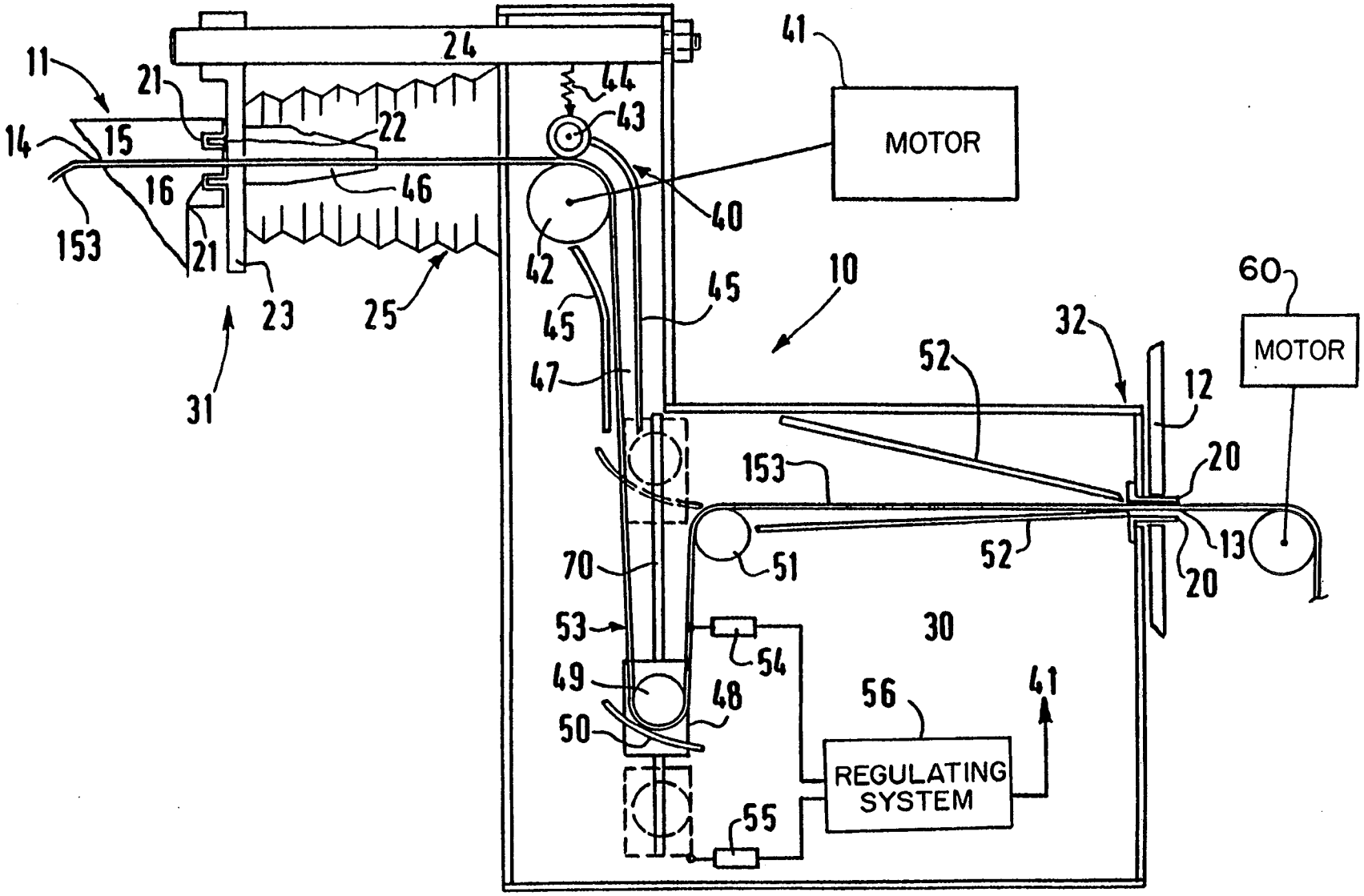
MOTOR
60
12
20
13
20
32
52
52
41
REGULATING SYSTEM
56
30
MOTOR
41
10
153
51
54
55
48
40
45
44
43
42
45
47
70
53
49
50
24
46
22
25
23
31
21
21
16
15
11
14
153

INTERFACE DEVICE BETWEEN A FEEDING DEVICE AND A RECEIVING STATION FOR PHOTOGRAPHIC MATERIAL

FIELD OF THE INVENTION

The invention relates to photography and, more particularly, to an interface device allowing a high capacity packaging to be connected to a printing machine.

BACKGROUND OF THE INVENTION

The existing printing machines most often use photographic magazines such as described, for instance, in the U.S. Pat. No. 4,741,439. Such magazines allow an easy use of photographic printing machines since there is no need for a room in which it must be possible to establish a complete darkness any longer. However, taking into account the weight of such magazines, the length of the rolls is limited (lower than 500 m) and the magazines must be often replaced.

The applicant has developed a new type of packaging described in the French patent application filed on Jun. 8, 1990, and called "Packaging for web photographic products". Such packaging contains several webs of photosensitive product wound around tube expanders resting on a spindle, each roll having a length of possibly 1500 m approximately, or more. As set forth in the application mentioned earlier, this type of packaging is fitted with several light-tight slots through which the photosensitive webs can be pulled out.

However, owing to the great length of each of the wound webs, and, consequently, to the roll weight, there are high friction forces. In view of this, the tension force required to pull the web out of this type of packaging is greater than the tension force required to pull webs out of photographic magazines with a relatively small capacity available off the shelf at this time. This phenomenon prevents the available printing machines from being directly connected to the new type of packaging since the tension force exerted by the printing machine feeding device has not a value high enough for the time being.

Moreover, during the feeding of the photographic webs from the packing to the printer, the length of the photographic web which is fogged has to be limited to its minimum. An object of the invention is an interface device liable to be adapted to the packaging described in the French patent application filed on Jun. 8, 1990, and called "Packaging for web photographic products".

The abstract of JP-A-58108663 published on Jan. 8, 1985 describes a device which renders the feeding of the paper independant of inertia resistance and frictional forces applied by the feeding roller. This device allows the formation of a paper loop so as to avoid inertia resistance from breaking the paper weg during the feeding operation.

Document DE-A-3,034,083 describes a processing device wherein a loop is formed between the paper cassette and the entry slot of the processing device. Said loop is regulated through photocell means.

Document U.S. Pat. No. 4,429,988 describes a photographic printer wherein the web travels along a track having loops so as to render substantially independent the functionning of the various device acting on the web.

Another object of the invention is an interfacing device which not only eliminates the influences of various forces on the web to move it but also prevents, at the same time, the fogging of the photographic web along an important length during the introduction of the leading edge of the web in the printer, said introduction being substantially automated.

SUMMARY OF THE INVENTION

Such object is attained by using an interface device between a reception station for web photosensitive product fitted with a feeding opening and a driving device liable to make a web inserted into the feeding opening move according to a given tension force, and a feeding device delivering said web through at least a delivery slot, and for which the tension force to be applied to the web for pulling it out of the feeding device, is greater than the given tension force. Such device is characterized by;

a) a first means, which is light-tight when it participates with the receiving station, to connect the device to the receiving station and allow the web to enter the receiving station;

b) a second means comprising an element movable between a retracted position wherein the interfacing device does not cooperate with the feeding device and wherein introduction in said interfacing device of a web which exits from the feeding device is possible and an extended position wherein said element participates with the feeding device to provide, during operation, light-tightness, therely limiting to two dimensions the positioning adjustment of the feeding device;

c) means for: 1) during the loading operations, to make the web emerging from the feeding device run over a first feed trajectory connecting the first means with the second means, and 2) when in service, to define another trajectory in which the web forms at least one loop to limit the necessary tension forces to be applied on the web to make it move at a value lower than the said given tension force, and to control a regulation system;

d) a driving device, located upstream of the said loop, to apply on the web entering the second means, tension forces high enough to pull the web out of the feeding device, and connected with the regulation system so as to limit the variations in the loop size around a medium position.

BRIEF DESCRIPTION OF THE DRAWINGS

Other advantages of the invention will appear on reading of the description which follows with reference to the sketch appended in which the single FIG. represents in a simplified manner an embodiment of the interface device according to the invention.

DETAILED DESCRIPTION OF THE DRAWING

The interface device 10 according to the invention is used to connect in a light-tight manner a feeding device 11 (of which only the portion which directly participates with the device according to the invention has been represented) with a receiving station 12 (of which only the feed opening 13 and first drive device for pulling the web through the feed opening with a given tension force are represented). The feeding device 11 serves to deliver a web 153 of photosensitive product and for example is described in the French patent application filed by the applicant on Jun. 8, 1990, and called "Packaging for web photographic products". The feeding device 11 is fitted with at least a discharge slot 14 delineated by an upper lip 15 and a lower lip 16. The receiving station 12 can be, for instance, a photographic printing machine which consists of a feeding system allowing a given tension force to be applied onto a web inserted into the feed opening 13 of the printing machine. The interface device comprises a casing 30 which is light-tight and fitted with an inlet 31 and an outlet 32.

The outlet 32 is fitted with a first means mainly consisting of the lips 20 set at the outlet of the device. The lips 20 are so designed that they participate with the feed opening 13 of the receiving station so as to obtain light-tightness when the lips 20 enter the feed opening 13.

The inlet 31 is fitted with a second means allowing the device according to the invention to be connected with the feeding device 11. The lips 15 and 16 of the feeding device 11 are, for example, fitted with grooves 21 set around the web 153 pulled out of the slot 14. The interface device is fitted with a complementary portion 22 on the grooves 21 which is designed to participate with the grooves 21 so that, when in service, the participation of the grooves 21 and complementary portion 22 provides a light-tightness.

In a preferred embodiment of the invention, the complementary portion 22 is fastened on a mobile element 23. The element 23 slides on columns 24 built in with the casing 30; it is connected with the casing 30 through a bellows 25 which allows the light-tightness to be withheld. It is obvious that other embodiments can be contemplated to connect the delivery slot on the feeding device with the inlet 31 of the device 10 according to the invention. The preferred feeding device is analogous to the packaging described in the "Packaging for web photographic products". The packaging comprises several individual webs arranged next to each other and pulled out of the packaging through the light-tight slot 14. As set forth in the application mentioned above, when using the packaging, the latter is moved by the distance equal to that separating the longitudinal axes of the two webs in order to use the next web when a web ends.

The mobile element 23 slides on the columns 24 between a retracted position wherein the interfacing device does not cooperate with the feeding device and wherein a web which exists of the feeding device is introduced into the interfacing device and an extended position wherein said element cooperates with the feeding device to ensure, during operation, light tightness.

Moreover, this movement simplifies the positioning system of the feeding device. As a matter of fact, the feeding device needs to be registered relative to the interfacing device. The movement of the element 23 permits to use a two dimension positioning system for the feeding device.

The device according to the invention also comprises a driving device 40 fitted with a motor 41 connected to a driving roller 42. The driving roller is associated with a compression roller 43 urged by springs 44 so as to come into contact with the driving roller 42. Downstream of the driving devices, bent guides 45 are arranged which delineate a chute 47 through which the web of photosensitive paper is pulled.

In order to feed the interface device 10 according the invention, the mobile element 23 is arranged in its home position so as to allow for room between the interface device 10 and the feeding device 11. In the home position, a cam 46 supported by the mobile element 23 participates with the compression roller 43 to set it away from the driving roller 42, and leave room between the driving roller 42 and the compression roller 43. After the mobile element 23 has been arranged in its home position, the web emerging from the slot 14 is inserted manually between the driving roller 42 and the compression roller 43, and the mobile element 23 is arranged again in its extended position. The complementary portion now participates with the grooves 21 to provide light-tightness. The compression roller 43 being no longer in contact with the cam 46 and being urged by the springs 44 presses the web onto the driving roller 42. The motor 41 of which torque is sufficient to pull the web out of the slot 14 of the feeding device 11, is then excited. The web then enters the chute 47 and reaches a mobile trolley 48 guided, for instance, on a rod 70 and fitted with a freely rotating roller 49 and diverter 50. On loading, the mobile trolley 48 is in high position (in dotted lines) so that the diverter 50 directs the web above a take-up roller 51 toward a second pair of guides 52. This second pair of guides directs the web toward the outlet 32 between the lips 20. A detection system (not represented) indicates the delivery of the web through the lips 20. It is obvious that a time-lag or any other equivalent means can be used in lieu of a detection. When the web emerges from the device 10, the mobile trolley 48 is lowered while moving the web through the use of the driving roller 42 so as to form a loop 53. The roller 49 is used to divert the web so as to form a loop while the take-up roller 51 allows the web to be directed toward the outlet 32. Detection means consisting of single-throw switches 54 and 55 are arranged on the trajectory of the mobile trolley which allow the loop length to be known. The detection means 54, 55 are connected to a regulating system 56. The regulating system allows the rotation speed of the motor 41 to be controlled. When the switch 55 is put in ON position, thus indicating that the mobile trolley 48 is in its lower position, the motor 41 is stopped, which reduces the length of the loop 53 when the printing machine pulls on the web photosensitive product. When the two-way switch 54 indicates that the trolley moves toward its low position, the motor 41 moves the web at a speed close to the speed required for proper operation of the printing machine and when the switch 54 indicates that the trolley moves toward its high position, the motor drives the web at a speed much higher than that of the printing machine.

Owing to the fact the rollers 49 and 51 can rotate freely, the friction forces exerted upon the web are as low as possible. The loop thus defines a means to limit the tension forces required for pulling the web out. The motor 41 serves to feed the web and the loop is used to control the feed rate. The interface device 10 according to the invention acts as an adapter between the tension forces. This device allows feeding of a printing machine fitted with a driving device 60 which has a low tension force with a feeding device 11 or delivering magazine of which tension force required to pull the web out is higher than the tension force prone to be exerted by the photographic printing machine.

Improvements of the interface device according to the invention can also be contemplated. Instead of making only one loop, a series of several loops can be achieved, thus providing a time-lag allowing the replacement of the web by glueing the webs to each other. Provision should, however, be made for a system to detect glueing 20 as not to make exposure on the fogged portion of the web in the vicinity of the glueing since the web was pulled out of the slot 14 of the feeding device 11. Provision could also be made for an automatic glueing device used to abut a web to the preceding web. It is obvious that the second means could be adapted to receive all the webs while delivering a web only when the preceding web has been consumed.

I claim:

1. An interface device positioned between a receiving station and a feeding device, said feeding device capable of delivering photosensitive web through a discharge slot in said feeding device to said interface device with said web having a first tension, said receiving station being provided with a feed opening and a first driving device for withdrawing the web from the interface device and into the feed opening of the receiving station with said web having a second tension, said second tension being higher than said first tension, said interface device comprising:

a) a first means for connecting the receiving station in a light tight relation with the interface device;

b) a second means for connecting the feeding device in a light tight relation with the interface device, said second means comprising an element movable between a retracted position wherein the interface device does not cooperate with the feeding device and wherein introduction in said interfacing device of said web which exits from the feeding device is possible, and an extended position wherein said second means participates with the feeding device to provide, during operation, light tightness;

c) means: 1) during loading operations, to make the web delivered by the feeding device, move over a first feed trajectory between the first means and the second means, and 2) when in service, to define a second trajectory in which he web has one loop at least to limit the required tension forces to be applied onto the web so as to move it at a value lower than the first tension force;

d) a second driving device set upstream of the loop, exerting onto the web entering the second means, tension forces high enough to pull the web out of the feeding device said second diving means cooperating with a regulating system for controlling the length of the loop.

2. The interface device in accordance with claim 1 wherein the second driving device comprises a driving roller and a freely rotating compression roller which is urged so as to come into contact with the driving roller and the displacement of the element to its retracted position separates the compression roller from the driving roller.

* * * * *